US009452904B2

(12) United States Patent
Furuya et al.

(10) Patent No.: US 9,452,904 B2
(45) Date of Patent: Sep. 27, 2016

(54) GUIDE MEMBER AND TRANSPORT DEVICE

(71) Applicant: FUJI XEROX CO., LTD., Tokyo (JP)

(72) Inventors: Takao Furuya, Kanagawa (JP); Seigo Makida, Kanagawa (JP); Kiyoshi Hosoi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/635,104

(22) Filed: Mar. 2, 2015

(65) Prior Publication Data

US 2016/0083210 A1 Mar. 24, 2016

(30) Foreign Application Priority Data

Sep. 18, 2014 (JP) ..... 2014-190311

(51) Int. Cl.

| | |
|---|---|
| ***B65H 9/00*** | (2006.01) |
| ***B65H 5/06*** | (2006.01) |
| ***B65H 7/20*** | (2006.01) |
| ***B65H 5/26*** | (2006.01) |
| ***G03G 15/00*** | (2006.01) |

(52) U.S. Cl.

CPC ..... *B65H 9/00* (2013.01); *B65H 5/062* (2013.01); *B65H 5/26* (2013.01); *B65H 7/20* (2013.01); *G03G 15/602* (2013.01); *B65H 2404/611* (2013.01); *B65H 2404/694* (2013.01); *B65H 2404/742* (2013.01); *G03G 2215/00189* (2013.01)

(58) Field of Classification Search

CPC ..... B65H 29/52; B65H 2404/611; B65H 2404/694; B65H 2404/742; G03G 15/602; G03G 2215/00189

USPC ..... 271/264; 399/367; 358/498

See application file for complete search history.

(56) References Cited

U.S. PATENT DOCUMENTS

| | | | | |
|---|---|---|---|---|
| 5,893,558 | A * | 4/1999 | Konig et al. | 271/264 |
| 6,152,445 | A * | 11/2000 | Hirota et al. | 271/315 |
| 6,241,245 | B1 * | 6/2001 | Hollar et al. | 271/314 |
| 7,021,618 | B2 * | 4/2006 | Watanabe et al. | 271/3.14 |
| 7,403,314 | B2 * | 7/2008 | Tsuchiya | 358/498 |
| 7,556,260 | B2 * | 7/2009 | Yoshimoto et al. | 271/188 |
| 7,669,848 | B2 * | 3/2010 | Watanabe | 271/264 |
| 8,322,714 | B2 * | 12/2012 | Satomi | 271/264 |
| 8,434,760 | B2 * | 5/2013 | Sadamitsu | 271/264 |
| 8,699,099 | B2 * | 4/2014 | Miyakoshi | 358/498 |
| 2005/0271436 | A1 * | 12/2005 | Worley et al. | 399/367 |
| 2010/0254744 | A1 * | 10/2010 | Taniguchi | 400/582 |
| 2015/0054219 | A1 * | 2/2015 | Makida et al. | 271/270 |

FOREIGN PATENT DOCUMENTS

JP 2003-221146 8/2003

OTHER PUBLICATIONS

Abstract and machine translation of JP 2003-221146.

* cited by examiner

*Primary Examiner* — Patrick Cicchino
(74) *Attorney, Agent, or Firm* — Fildes & Outland, P.C.

(57) ABSTRACT

There provided a guide member including: a first guide member that is disposed to face a first surface of a sheet which is transported to a first direction and that guides the sheet in front and at the rear of a processing position at which a process is performed on the first surface; and a second guide member that is disposed to face a second surface of the sheet and guides the sheet, wherein the second guide member includes specific plural convex portions.

18 Claims, 18 Drawing Sheets

GUIDE MEMBER AND TRANSPORT DEVICE

CROSS-REFERENCE TO RELATED APPLICATION(S)

This application is based on and claims priority under 35 U.S.C. 119 from Japanese Patent Application No. 2014-190311 filed on Sep. 18, 2014.

BACKGROUND

1. Technical Field

The present invention relates to a guide member and a transport device.

2. Related Art

Conventionally, there has been provided an original document supplying apparatus that includes a rib unit which decreases sliding friction between portions in front and at the rear of a position facing an image reading point and a bad surface of an original document.

SUMMARY

According to one aspect of the invention, there is provided a guide member including: a first guide member that is disposed to face a first surface of a sheet which is transported to a first direction and that guides the sheet in front and at a rear of a processing position at which a process is performed on the first surface; and a second guide member that is disposed to face a second surface of the sheet and guides the sheet, wherein the second guide member includes first plural convex portions and second plural convex portions, the first plural convex portions are arranged in a second direction which forms a first angle to the first direction, the second plural convex portions are arranged in the second direction which firms a second angle to the first direction, the first plural convex portions are present in a first region including: the processing position and a second region not including the processing position, and an average of intervals between the first plural convex portions is smaller than an average of intervals between the second plural convex portions.

BRIEF DESCRIPTION OF THE DRAWINGS

Exemplary embodiments of the present invention will be described in detail based on the following figure, wherein.

DETAILED DESCRIPTION

[1] Embodiment

Figure 1:
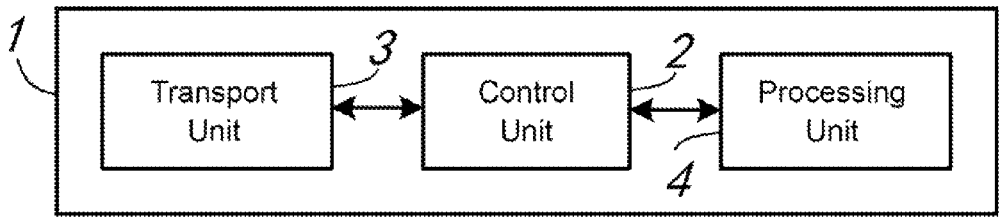
FIG. 1 is a diagram illustrating an entire configuration of a transport device.

FIG. 1 illustrates an entire configuration of a transport device 1. The transport device 1 transports a sheet such as paper or an overhead projector (OHP) film. According to the present embodiment, the transport device 1 transports the sheet on which an image discharged from an image forming apparatus (not illustrated) is formed. The transport device 1 includes a control unit 2, a transport unit 3, and a processing unit 4.

The control unit 2 has a central processing unit (CPU), a random access memory (RAM), a read only memory (ROM), and a storage unit such as a hard disk. The CPU executes a program stored in the ROM or the storage unit using the RAM as a work area and thereby controls each unit. The transport unit 3 transports the sheet along a transport path. The processing unit 4 performs a process on the sheet which is transported by the transport unit 3. According to the present embodiment, the processing unit 4 performs a process of reading an image formed on the sheet.

Figure 2:
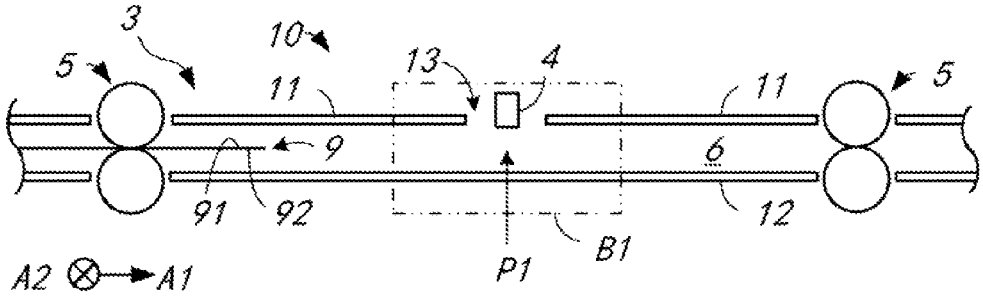
FIG. 2 is a view illustrating a configuration of a transport unit on the periphery of a processing unit.

FIG. 2 illustrates a configuration of the transport unit 3 on the periphery of the processing unit 4. The transport unit 3 includes a roller unit 5 and a guide member 10 which forms a transport path 6. Hereinafter, a direction in which the transport unit 3 transports the sheet is named "first direction A1". According to the present embodiment, the first direction A1 is along a horizontal direction on the periphery of the processing unit 4. The roller unit 5 has plural rollers which are rotatably supported and causes these rollers to rotate such that the sheet is transported along the transport path 6 in the first direction A1.

FIG. 2 illustrates a sheet 9 which is an example of the sheet transported by the roller unit 5. It is common that the sheet transported is deflected due to an effect such as a force of gravity. However, a state in which the sheet 9 is not deflected is illustrated for easy understanding of the description. FIG. 2 illustrates a portion along a surface of the sheet which is transported in a state in which, similar to the sheet 9, no deflection occurs when viewed from a second direction A2 which forms an angle (according to the present embodiment, 90 degrees) with the first direction A1.

The guide member 10 includes a first guide member 11 and a second guide member 12. The first guide member 11 is disposed to face a first surface 91 of the sheet 9, forms the transport path 6, and guides the sheet so as to be transported along the transport path 6 in front and at the rear (upstream side and downstream side in the first direction A1) of a processing position P1 at which a process on the sheet is performed by the processing unit 4. The second guide member 12 is disposed to face a second surface 92 of the sheet 9, forms the transport path 6, and guides the sheet so as to be transported along the transport path 6 in front and at the rear of the processing position P1.

In the first guide member 11, an opening 13, in which the transport path 6 leads to an outer space, is formed. The processing unit 4 is disposed in the opening 13. FIG. 2 illustrates the processing position P1 at which the process on the sheet is performed by the processing unit 4 of positions (that is, positions on the transport path 6) along the transport path 6. The processing unit 4 is disposed to face the first surface 91 of the sheet 9 passing through the processing position P1 and performs a process on the first surface 91. A B1 portion (portion including the processing unit 4) included in the transport unit. 3 which is illustrated in FIG. 2 is described with reference to FIG. 3.

Figure 3:
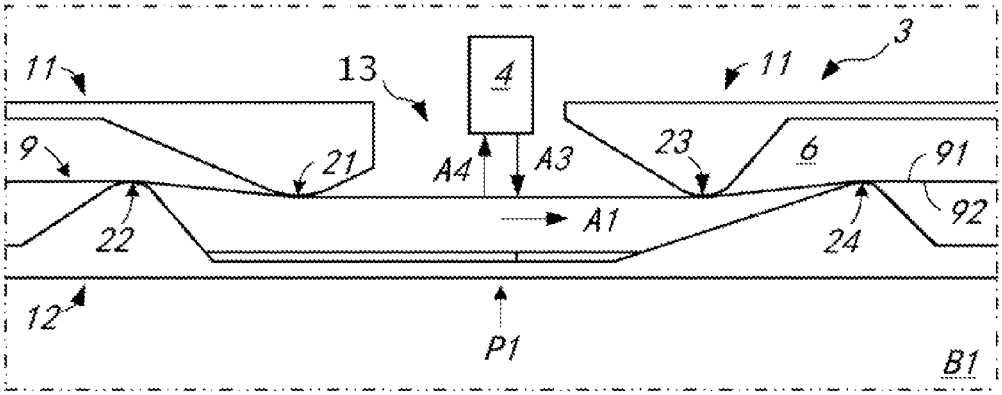
FIG. 3 is an enlarged view illustrating a B1 portion in FIG. 2.

FIG. 3 illustrates the enlarged B1 portion in FIG. 2. The first guide member 11 has a first contact region 21 on the upstream side from the processing position P1 in the first direction A1, and the second guide member 12 has a second contact region 22 further upstream from the first contact region 21. The first guide member 11 has a third contact region 23 on the downstream side from the processing position P1 in the first direction A1, and the second guide member 12 has a fourth contact region 24 further downstream from the third contact region 23. Hereinafter, in a case where solely "upstream" is described, the upstream represents upstream in the first direction A1 and, in a case where solely "downstream" is described, the downstream represents downstream in the first direction A1.

Both the first contact region 21 and the third contact region 23 are regions which come into contact with the first surface 91, and both the second contact region 22 and the fourth contact region 24 are regions which come into contact with the second surface 92. The first contact region 21 is disposed to a side in a direction (hereinafter, referred to as "third direction A3") toward the sheet 9 from the processing unit 4 in the processing position P1, from the second contact region 22. The third contact region 23 is disposed to a side in the third direction A3 from the fourth contact region 24. FIG. 3 illustrates a state in which a leading end of the sheet 9 is transported ahead of the fourth contact region 24 and the sheet 9 comes into contact with each contact region. To be more specific, a state is illustrated, in which the first surface 91 of the sheet 9 comes into contact with the first contact region 21 and the third contact region 23 and the second surface 92 comes into contact with the second contact region 22 and the fourth contact region 24.

Each of the contact regions is disposed as described above and, in the state illustrated in FIG. 3, a force toward a direction (hereinafter, referred to as a "fourth direction A4") opposite to the third direction A3 is applied to the second surface 92 of the sheet 9 by the second contact region 22 and the fourth contact region 24. Due to the force, the first surface 91 of the sheet 9 is pressed against the first contact region 21 and the third contact region 23. Accordingly, a state is maintained, in which the first surface 91 of the sheet 9 is in contact with the first contact region 21 and the third contact region 23.

The state maintained as described above causes variation of a distance between the processing unit 4 and the sheet 9 in the processing position P1 to become smaller, compared to a case where the four contact regions illustrated in FIG. 3 are not provided. In addition, the processing unit 4 is disposed so as to perform the process with the highest accuracy in a case where the first surface 91 of the sheet 9 forms a predetermined angle (for example, 90 degrees) to the third direction A3. The first contact region 21 and the third contact region 23 are formed such that the first surface 91 and the third direction A3 form the predetermined angle therebetween, in the state illustrated in FIG. 3. Accordingly, the state in which the processing unit 4 performs the process with the highest accuracy is likely to be maintained, compared to the case where the four contact regions are not provided.

Figure 4:
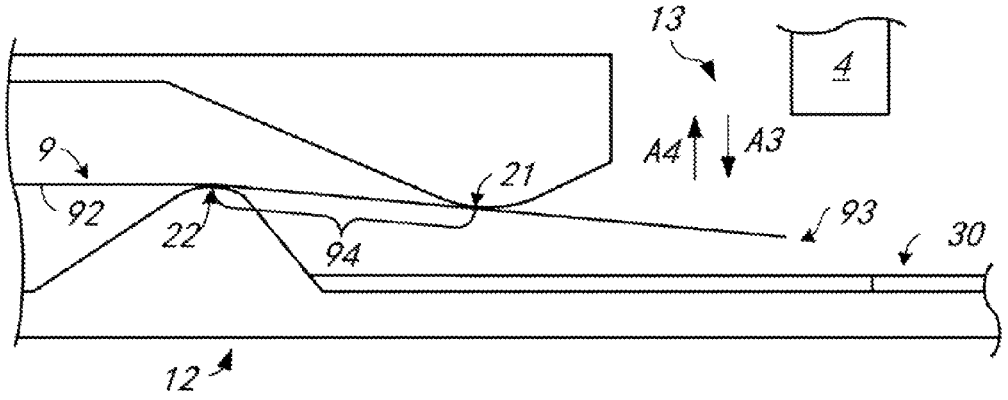
FIG. 4 is an enlarged view illustrating a first contact region and a second contact region.

FIG. 4 illustrates the enlarged first contact region 21 and second contact region 22. FIG. 4 illustrates a state in which a leading end 93 side of the sheet 9 is in contact with the first contact region 21 and the second contact region 22. As described above, the first contact region 21 is disposed to a side in the third direction A3 from the second contact region 22. This disposition causes the sheet to be transported in a state in which the downstream side of a portion 94 of the sheet 9 which is sandwiched between the both the contact regions slopes to the second surface 92 side (or the third direction A3), that is, in a state in which the downstream side of the portion 94 is inclined in a direction in which the portion 94 is away from the processing unit 4 and the opening 13. Accordingly, shooting out of the sheet from the opening 13 and collision of the sheet with the processing unit 4 are prevented, compared to a case where the first contact region 21 and the second contact region 22 disposed as in the present embodiment are not provided.

The sheet 9 is transported in a state of being inclined to the second surface 92 as described above and thereby, the leading end 93 side is likely to come into contact with the second guide member 12, compared to a case where this inclination does not occur. In addition, when the sheet 9 is further transported such that the following end side of the sheet is not in contact with the first contact region 21, the third contact region 23 and the fourth contact region 24 cause the following end side of the sheet 9 to be inclined to the second surface 92 side. Accordingly, compared to a case where the following end is not inclined, the following end side of the sheet 9 is likely to come into contact with the second guide member 12. The second guide member 12 has plural convex portions 30 arranged in the second direction A2 in a portion with which the leading end 93 or the following end side of the sheet 9 are likely to come into contact and in each of a region (hereinafter, referred to as "first region") including, the processing position P1 and a region (hereinafter, referred to as "second region") which does not include the processing position P1. The plural convex portions 30 are described with reference to FIG. 5 to FIG. 7.

Figure 5:
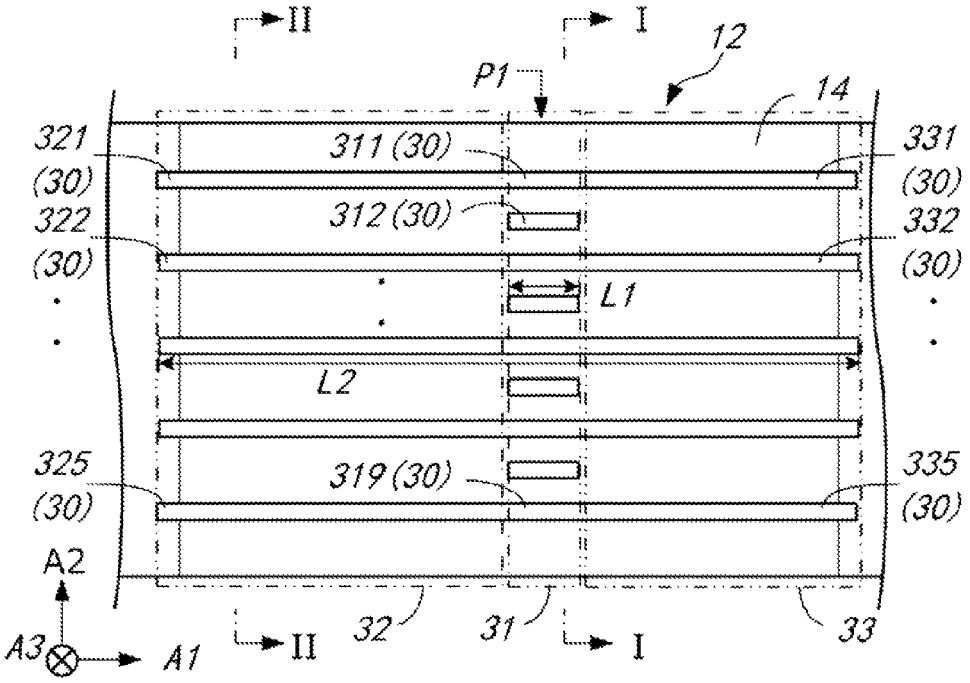
FIG. 5 is a view illustrating a second guide member when viewed from a third direction.

FIG. 5 illustrates the second guide member 12 when viewed from the third direction A3. The second guide member 12 has a plate-shaped substrate 14 and a lengthy member (hereinafter, referred to as "rib") which is formed on the substrate 14 and in which the first direction A1 becomes the longitudinal direction. Four first ribs of which the length in the first direction A1 becomes L1 and five second ribs of which the length in the first direction A1 becomes L2 (L2 is longer than L1) are formed on the substrate 14. The first ribs and the second ribs are provided to be arranged alternately in the second direction A2 and all ribs are provided to straddle the processing position P1. According to the present embodiment, a region by which the first ribs are circumscribed, in a rectangular region that has sides along the first direction A1 and the second direction A2, is named a first region 31 described above. The first region 31 is a region which comes into contact with a rear side of a portion of the sheet on which the process is performed. In addition, two rectangular regions which are continuous with the first region 31 and are present on the upstream side and the downstream side of the first region 31 in the first direction A1 are a second region 32 and a second region 33 described above, respectively.

The first ribs and a portion closer to the center of the second ribs are included, in the first region 31 and are provided to be able to come into contact with the second surface 92 of the sheet 9. That is, the first ribs and the portion of the second ribs are plural convex portions 30 provided in the first region 31. Specifically, nine convex portions of convex portions 311 to 319 (in a case of not distinguishing one from the others referred to as "convex portions 30") are provided in the first region 31 to be arranged in the second direction A2. Portions of the second ribs on the upstream side in the first direction A1 are included in the second region 32 and portions of the second ribs on the downstream side in the first direction A1 are included in the second region 33. All the portions are provided to be able to come into contact with the second surface 92 of the sheet 9.

Specifically, five convex portions of convex portions 321 to 325 are provided in the second region 32 to be arranged in the second direction A2 and five convex portions of convex portions 331 to 335 (in a case of not distinguishing one from the others referred to as "convex portions 30") are provided in the second region 33 to be arranged in the second direction A2. In this manner, the number of (hereinafter, referred to as a "first number", according to the present embodiment, 9) convex portions 30 provided in the first region 31 is greater than the number of (hereinafter, referred to as a "second number", according to the present embodiment, in both, 5) convex portions 30 provided in each of the second region 32 and the second region 33. In addition, the plural convex portions 30 are provided in a direction in which the first direction A1 is the longitudinal direction.

Figure 6:
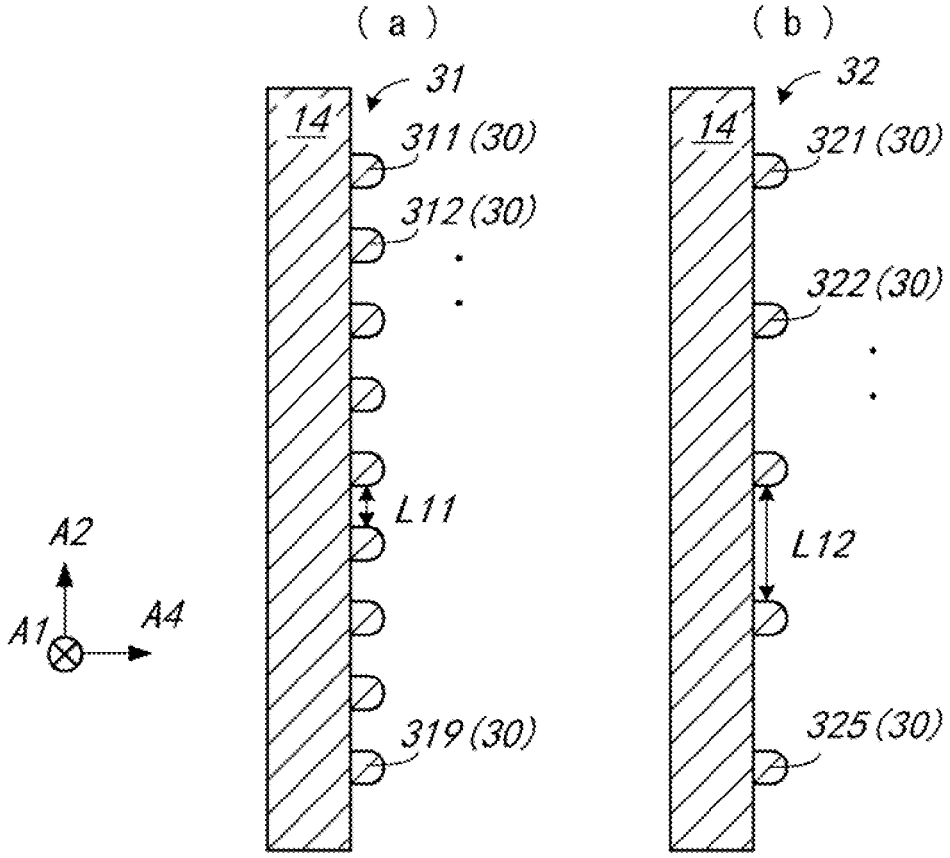
FIG. 6 illustrates convex portions when viewed from a direction of an arrow in FIG. 5.

FIG. 6 illustrates plural convex portions 30 when viewed from a direction of an arrow in FIG. 5. FIG. 6(*a*) illustrates a cross-section of the plural convex portions 30 and the substrate 14 when viewed in a direction of arrow I-I. The nine convex portions 311 to 319 provided in the first region 31 illustrated in FIG. 5 are provided on the substrate 14 to be arranged in the second direction A2 at a first interval L11. FIG. 6(*b*) illustrates a cross-section of the convex portions 30 and the substrate 14 when viewed in a direction of arrow II-II. The five convex portions 321 to 325 provided in the second region 32 illustrated in FIG. 5 are provided on the substrate 14 to be arranged in the second direction A2 at a second interval L12. A cross-section of the five convex portions provided in the second region 33 illustrated in FIG. 5 is the same as illustrated in FIG. 6(*b*).

As described above, the first number, that is, the number of the plural convex portions 30 in the first region 31, is greater than the second number, that is, the number of the plural convex portions 30 in the second regions 32 and 33. In addition, since a distance between the convex portions (convex portions 311 and 319 in the first region 31, convex portions 321 and 325 in the second region 32, and convex portions 331 and 335 in the second region 33) provided at the ends of the plural convex portions 30 in the second direction A2 becomes a distance between the ribs provided at the ends of all regions in the second direction A2, each is the same distance.

That is, an average of the intervals between the plural convex portions 30 in the first region 31 is smaller than an average of the intervals between the plural convex portions 30 in the second regions 32 and 33. Here, the average means an arithmetic average (value obtained by dividing the sum of the intervals by the number of intervals). According to the present embodiment, all of the intervals between the plural convex portions 30 in the first region 31 are L11 and thus, the average is L11. In addition, all of the intervals between the plural convex portions 30 in the second regions 32 and 33 are L12 (L12 is greater than L11) and thus, the average is L12.

In a case where each of the convex portions 30 is viewed in the first direction A1 as illustrated in FIG. 6, an end portion on the fourth direction A4 side (first guide member 11 side) is round. The surface of the round end portion forms a shape of an outer circumferential surface of a cylinder. Accordingly, frictional force acting on the sheet is decreased when the sheet comes into contact with the convex portions 30, compared to a case where each of the convex portions 30 has, for example, a flat surface on the side in the fourth direction A4. The end portion of each of the convex portions 30 on the side in the fourth direction A4 may be formed of a protruding front or may have a saw shape having plural tips. It is desirable to have a shape which produces less friction with the sheet.

The end of the convex portion 30 may be formed of the flat surface described above. Even in this case, an area of the sheet which comes into contact with the second guide member 12 is decreased and the frictional three acting on the sheet is decreased, compared to a case where only the substrate 14 is provided in the second guide member 12. In this manner, each of the convex portions 30 may be a portion in the second guide member 12 which has a protruding shape when viewed in the first direction A1. In other words, each of the convex portions 30 may be a portion which protrudes in the third direction A3 more than an adjacent portion (according to the present embodiment, the substrate 14) in the second direction A2.

Figure 7:
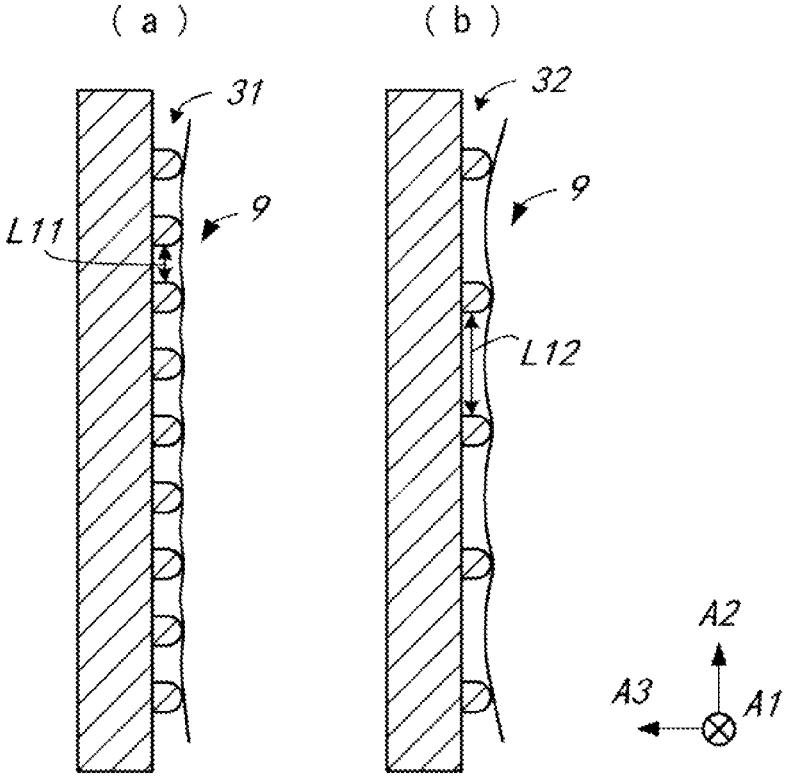
FIG. 7 is a view illustrating an example of a state in which a sheet comes into contact with the convex portion.

FIG. 7 illustrates an example of a state in which the sheet comes into contact with the convex portions 30. In FIG. 7(*a*), the nine convex portions 30 provided in the first region 31 are in contact with the sheet 9. In FIG. 7(*b*), the five convex portions 30 provided in the second region 32 are in contact with the sheet 9. In this manner, since the sheet 9 is not in contact with the substrate 14 but in contact with only the plural convex portions 30 in both the first region 31 and the second region 32, the frictional force applied to the sheet is decreased and reduction of the transport speed of the sheet in the processing position P1 is prevented, compared to a case where the plural convex portions 30 are not provided and the sheet comes into contact with the substrate 14. Portions of each sheet 9 which are positioned in spaces between adjacent convex portions 30 are deflected to the side in the third direction A3 in both the first region 31 and the second region 32. However, since the average of the intervals between the plural convex portions 30 in the first region 31 is smaller than that in the second region 32 (L11<L12), the degree of the deflection in the first region 31 is lowered over the entire region in the second direction A2. Since the first region is a region including the processing position P1, according to the present embodiment, the reduction of the transport speed of the sheet is prevented at the processing position P1 at which the process is performed during the transportation and the deflection of the sheet at the processing position P1 is suppressed.

Figure 8:
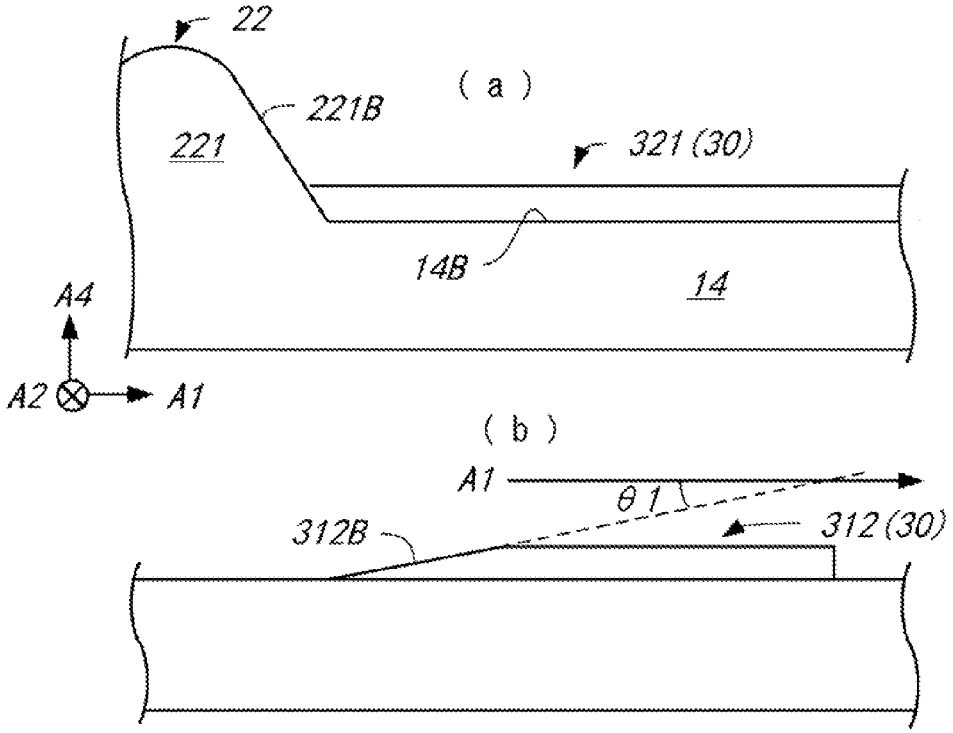
FIG. 8 illustrates enlarged diagrams illustrating an end portion on the upstream side of the convex portion.

FIG. 8 illustrates an enlarged end portion on the upstream side of the convex portion 30. FIG. 8(*a*) illustrates the end portion on the upstream side of the convex portion 321 illustrated in FIG. 5. The convex portion 321 is provided on a flat snake 14B of the substrate 14 on the side in the fourth direction A4. A flat surface 221B which slopes to the fourth direction A4 is provided on the upstream side from the flat surface 14B in the first direction. The flat surface 221B is a surface on the downstream side from the protrusion 221 in the first direction A1 having the second contact region 22. The upstream side of the convex portion 321 in the first direction A1 is connected to the flat surface 221B.

When a surface that intersects with the first direction A1, in which the sheet is transported, at an angle exceeding a predetermined angle (for example, 45 degrees) is provided, the leading end of the sheet collides with the surface and then, the side of the leading end of the sheet is likely to be bent. Here, an "intersecting angle" means the minimum angle among angles formed by a surface and the first direction A1. The surface of the convex portion 321 which is formed toward the upstream side in the first direction A1 is in close contact with the flat surface 221B such that the leading end of the sheet does not butt against the surface, and the other surfaces are all formed along the first direction A1. Accordingly, the leading end of the sheet does not butt against the convex portion 321 and is not bent.

FIG. 8(*b*) illustrates the end portion of the convex portion 312 illustrated in FIG. 5 on the upstream side in the first direction A1. Neither another convex portion 30 nor the flat surface 221B is provided on the upstream side of the convex portion 312 in the first direction A1. On the upstream side in the first direction A1, the convex portion 312 has a slope 312B which faces the first guide member 11 and slopes on the upstream side in the first direction A1. The slope 312B is a surface that intersects with the first direction A1 at an angle θ1. The angle θ1 is less than the predetermined angle described above and the leading end of the sheet is unlikely to be caught on the upstream side of the convex portion 312 in the first direction A1, compared to a case where the convex portion 312 does not have the slope 312B.

[2] Modification Example

The embodiment described above is provided only as an example of the invention and may be modified as follows. In addition, the embodiment described above and each modification example described below may be implemented as a combination thereof, as necessary.

[2-1] Interval of Plural Convex Portions

According to the present embodiment, the intervals of the plural convex portions 30 are substantially equal to each other. However, there is no limitation to the intervals and the intervals may have various values. Even in this case, when the average of the intervals in the first region 31 is smaller than the average of the intervals in the second regions 32 and 33, the degree of the deflection of the sheet becomes lowered on the side of the first region 31 as a whole although there is a case where the degree of the deflection of the sheet becomes greater partially on the side of the second region.

Figure 9:
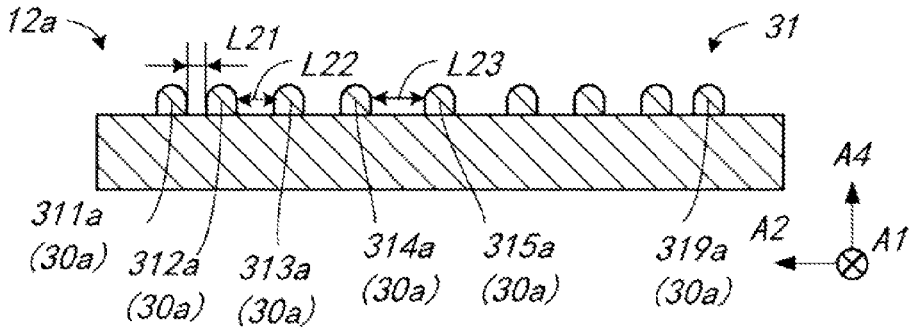
FIG. 9 is view illustrating a second guide member of a modification example.

In addition, the plural convex portions 30 may have intervals as illustrated in FIG. 9.

FIG. 9 illustrates a second guide member 12*a* of the present modification example. The second guide member 12*a* has nine convex portions 311*a* to 319*a* in the first region 31. When comparing L21 which is an interval between the convex portions 311*a* and 312*a*, L22 which is an interval between the convex portions 312*a* and 313*a*, and L23 which is an interval between the convex portions 314*a* and 315*a*, the relationship of L21<L22=L23 is satisfied. That is, plural convex portions 30*a* in the first region 31 are arranged on a side closer to an end at an interval less than at the center in the second direction A2.

The deflection is unlikely to occur in a portion closer to the center in the second direction A2 of the sheet which is in contact with the plural convex portions 30*a* because of the weight of the sheet that is present on both sides in the second direction A2. However, the deflection is likely to occur in a portion closer to the end because the weight of the sheet on one side becomes smaller. In an example of FIG. 9, the convex portions 30*a* on the side closer to the end in the second direction A2, in which the deflection is likely to occur, are arranged at a narrower interval and then, deviation of the deflection over the entire sheet along the second direction A2 is decreased, compared to a case where the intervals between the convex portions become equal.

[2-2] Direction of the Plural Convex Portions

The plural convex portions 30 are disposed in a direction in which the first direction A1 is a longitudinal direction but there is no limitation thereto.

Figure 10:
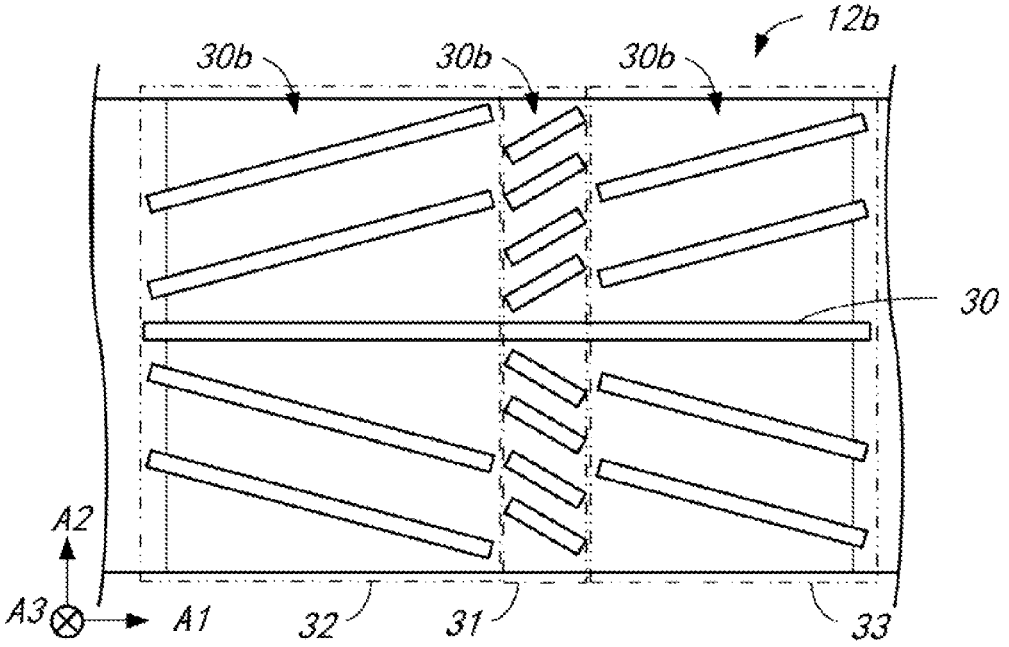
FIG. 10 is a view illustrating a second guide member of another modification example.

FIG. 10 illustrates a second guide member 12*b* of the present modification example. The second guide member 12*b* has sloping convex portions (hereinafter, referred to as "sloping convex portion 30*b*") with respect to the first direction A1 in the first region 31 and the second regions 32 and 33. The convex portions 30 are provided along the first direction A1 at the center of the first region 31 in the second direction A2, and four sloping convex portions 30*b* are provided on each of the right and the left on the end side of the first region 31 in the second direction A2. In addition, two sloping convex portions 30*b* are provided on each of the right and the left in the second regions 32 and 33. All of the sloping convex portions 30*b* are inclined so as to be closer to the end of the second guide member 12*b* in the second direction A2, when proceeding to further downstream in the first direction A1. Accordingly, the end of the sheet in the second direction A2 is unlikely to be caught at the sloping convex portions 30*b*, compared to, for example, a case where an opposite side slopes.

Figure 11:
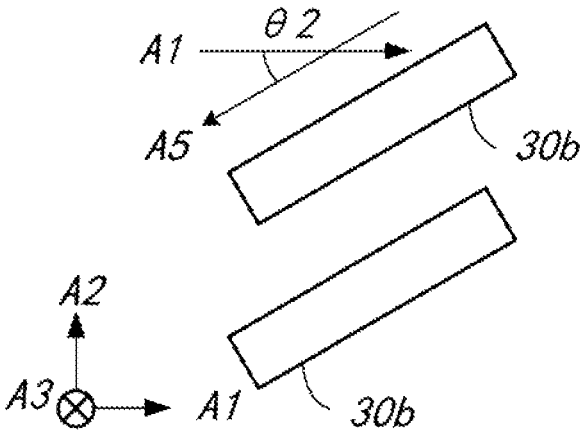
FIG. 11 is an enlarged diagram illustrating a sloping convex portion in a first region.

FIG. 11 illustrates the enlarged sloping convex portions 30*b* in the first region 31. A longitudinal direction A5 of the sloping convex portions 30*b* forms an angle θ2 (in this example, 30 degrees) to the first direction A1. When the angle θ2 becomes closer to 90 degrees, the sheet is likely to be caught at the sloping convex portions 30*b*. Therefore, the angle θ2 may be greater than 0 degrees, for example, about 45 degrees or less. When the angle θ2 becomes greater, the deflection of the sheet is prevented. The principle is described with reference to FIG. 12.

Figure 12:
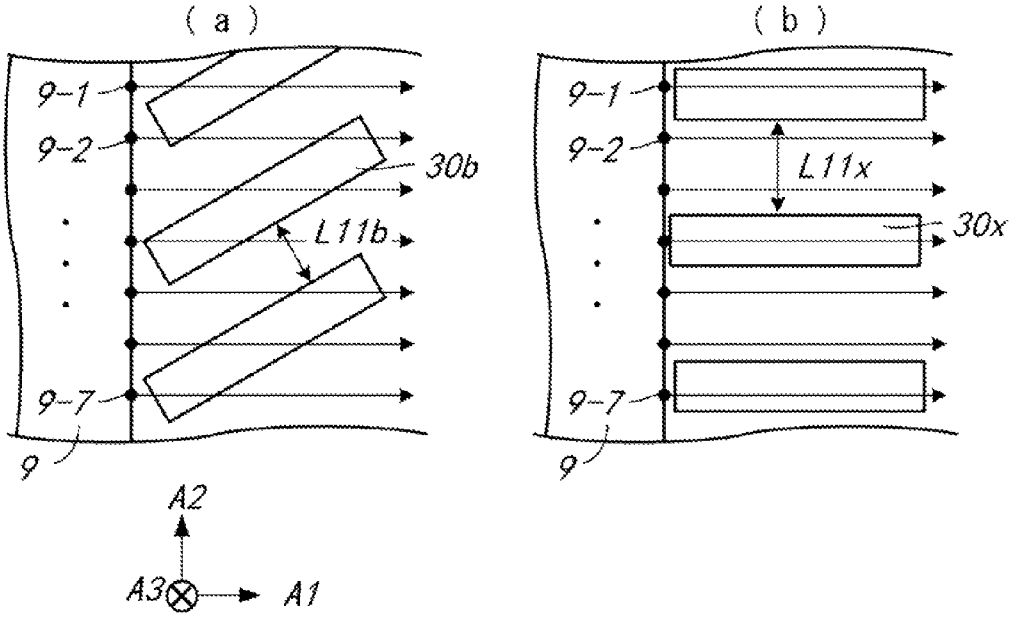
FIG. 12 is a view illustrating a principle of preventing a deflection of the sheet.

FIG. 12 is a view illustrating a principle of preventing the deflection of the sheet. FIG. 12 illustrates seven points 9-1 to 9-7, which are arranged in the second direction A2, of the leading end of the sheet which is transported in the first direction A1, and a path through which the points pass when proceeding in the first direction A1, as arrows. FIG. 12(*a*) illustrates the sloping convex portions 30*b* and FIG. 12(*b*) illustrates convex portions 30*x* of which the longitudinal direction corresponds to the first direction A1. In a case where the sheet 9 comes into contact with the convex portions 30*x*, for example, the points 9-2, 9-3, 9-5, and 9-6 do not come into contact with the convex portion 30*x* and the deflection is likely to occur.

In a case where the sheet 9 comes into contact with the sloping convex portions 30*b*, the points have to come into contact with the sloping convex portions 30*b* at an intermediate position and the deflection disappears before the deflection becomes greater. In addition, even when the number of the convex portions provided in the first region 31 is not changed, the distance between the sloping convex portions 30*b* (L11*b* in the drawing) becomes shorter, compared to a distance L11$x$ of the convex portions 30$x$. According to the present embodiment, due to these reasons, the deflection of the sheet is likely to be less, compared to a case where the longitudinal direction of the convex portions is not sloping to the first direction A1 unlike the convex portions 30$x$.

[2-3] Process Performed by Processing Unit

According to the present embodiment, the processing unit performs a process of reading an image. However, there is no limitation thereto, and for example, a process such as ejecting ink onto the sheet may be performed. In short, processing means may perform any process on the first surface of the medium. Particularly, in a case where the reduction of the transport speed of the sheet and the bending in the processing position is likely to have an effect on the result of the process, the application of the present invention prevents the transport speed from being reduced and suppresses the bending of the sheet, and prevents the bending of the sheet. Therefore, the accuracy of the process may be improved.

[2-4] Convex Portions in First Region

Convex portions different from the embodiment may be provided in the first region of the second guide member.

Figure 13:
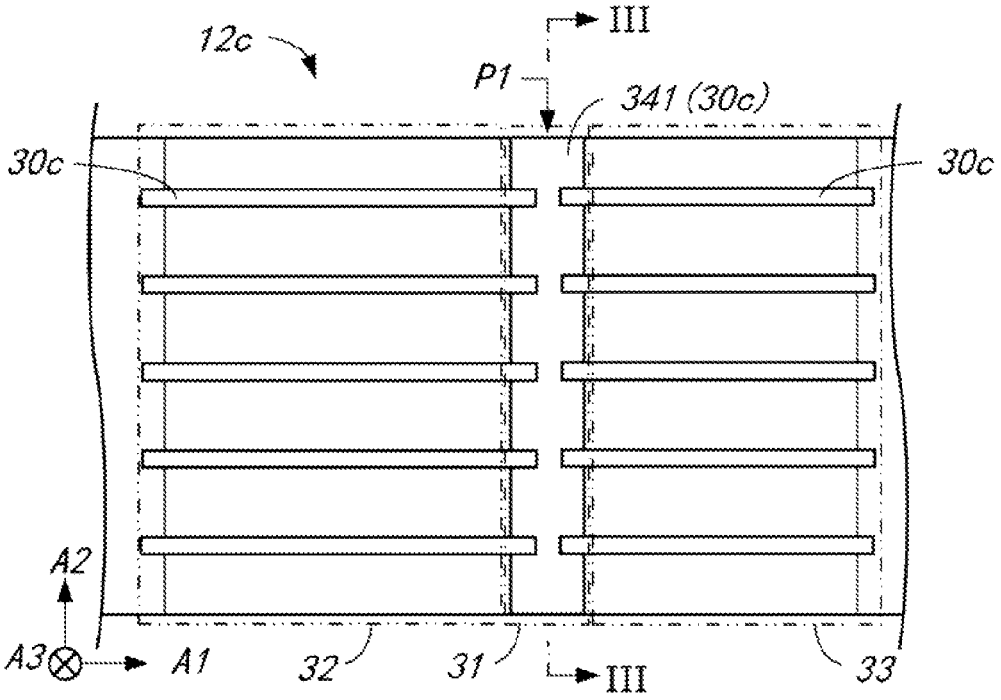
FIG. 13 is a view illustrating a second guide member of still another modification example.

FIG. 13 illustrates a second guide member 12$c$ of the present modification example. The second guide member 12$c$ has plural convex portions 30$c$ and four convex portions 30$c$ disposed to be arranged in the second direction A2 are provided in each of the second region 32 and the second region 33. In addition, the second guide member 12$c$ has a convex portion 341 which is one of the plural convex portions 30$c$ and is connected to the other plural convex portions 30$c$, in the first region 31. The convex portion 341 forms a rectangular shape of which the second direction A2 is the longitudinal direction in a case of being viewed in the third direction A3.

Figure 14:
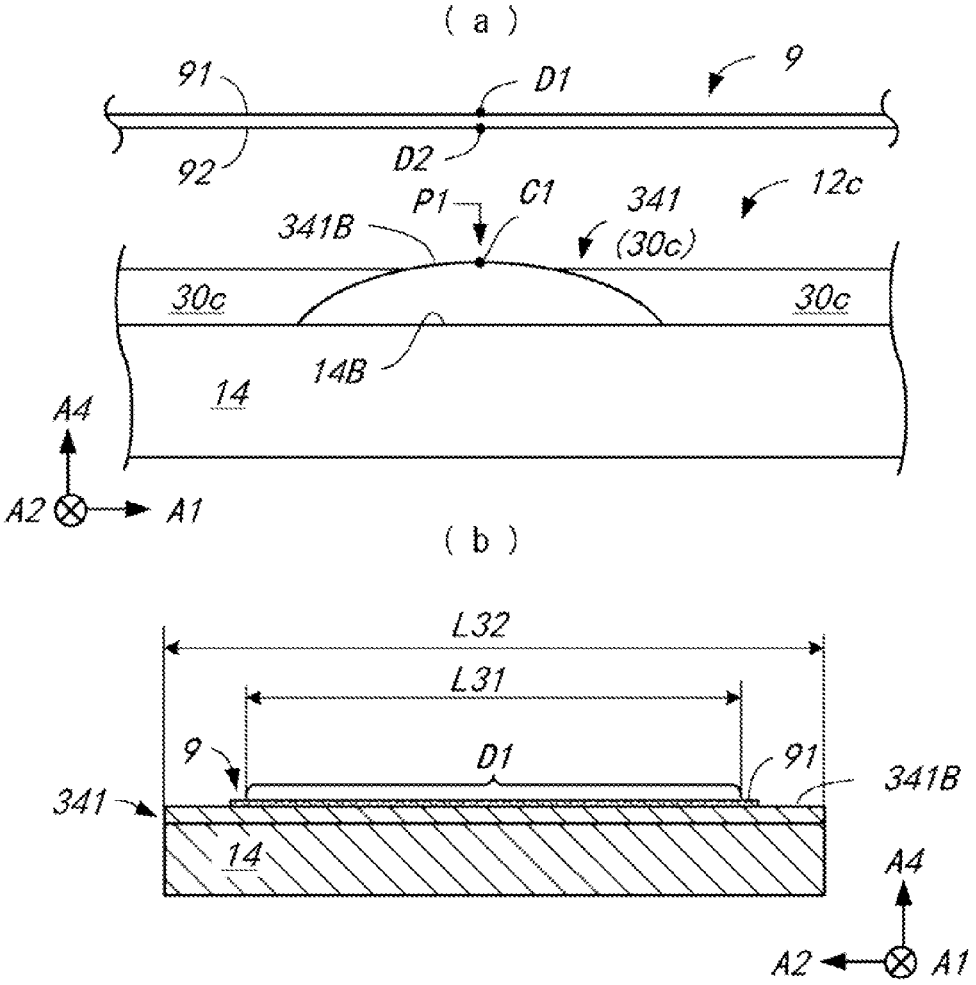
FIG. 14 is views illustrating a convex portion when viewed from another point of view.

FIG. 14 illustrates the convex portion 341 when viewed from another point of view. FIG. 14($a$) illustrates the convex portion 341 when viewed in the second direction A2. The convex portion 341 is formed so as to be higher when being closer to the center in the first direction A1 and is higher than the other convex portions 30$c$ at the apex C1. Here, the height means a height from the substrate 14. To be more specific, the convex portion 341 has a shape in which a cylinder that has a rotating axis along the second direction A2 is cut along a flat surface along the rotating axis. The cut surface is provided into a state that comes into contact with the flat surface 14B of the substrate 14. The convex portion 341 has a convex surface 341B on the side in the fourth direction A4 (first guide member 11 side), and the convex surface 341B has a shape in which a part of an outer circumferential surface of the cylinder is cut.

FIG. 14($a$) illustrates a portion in the first surface 91 of the sheet 9 (hereinafter, referred to as "processing portion D1") which is present in the processing position P1 and in which the process is performed, and the rear side D2 thereof. The convex portion 341 is disposed such that the apex C1 which has the greatest height from the substrate 14 is positioned at the processing position P1. Therefore, the rear side D2 of the processing portion D1 comes into contact with the convex surface 341B that is present on the apex C1.

FIG. 14($b$) illustrates a cross-section of the convex portion 341 and the substrate 14 viewed from arrow III-III in FIG. 13. In FIG. 14($b$), a cross-section of a sheet 9 in a state of being in contact with the convex surface 341B of the convex portion 341 and the processing portion D1 of the sheet 9 are illustrated. In the example, a portion which is not the processing portion D1 is included at the end side of the sheet 9 in the second direction A2 (the processing portion D1 may be provided at the end). A length of the processing portion D1 in the second direction A2 is L31 and a length of the convex surface 341B in the second direction A2 is L32 which is longer than L31. In this manner, the second guide member 12$c$ has the convex portion 341 which comes into contact with the entire rear side D2 of the processing portion D1 via a surface (of the convex surface 341B) along the second direction A2.

In a case where a reading process of an image formed on the sheet 9 is performed as in the present embodiment, a shadow of an object that comes into contact with the rear side D2 of the processing portion D1 of the sheet 9 is read through the sheet, for example, when the sheet 9 is thin paper, in some cases. The shade of the object is usually produced due to waviness of a contact surface that comes into contact with the rear side D2 in the second direction A2. In addition, the waviness causes the deflection of the sheet at the processing position P1 and, also when other processes are performed, has an influence on a result of the other processes.

According to the present embodiment, the entire rear side D2 of the processing portion D1 comes into contact with the convex surface 341B. Therefore, the influence of the object which comes into contact with the rear side D2 of the processing portion D1 on the process is suppressed, compared to a case where the second guide member does not have the convex portion 341.

The length of the convex surface 341B described above in the second direction A2 may be less than the length of the processing portion D1 in the second direction A2. In this case, in a portion at which the rear side D2 thereof comes into contact with the convex surface 341B, as a part of the processing portion D1, the influence to the process described above is suppressed. In addition, the surface that comes into contact with the rear side D2 of the processing portion D1 is a curved surface in the example described above. However, the surface may be a flat surface along the second direction A2. In addition, the convex surface 341B illustrated in FIG. 14 is a surface along the second direction A2 including a portion other than the portion (portion of the apex C1) which comes into contact with the rear side D2 of the processing portion D1. However, there is no need to form the surface along the second direction A2 because the portion other than the portion which comes into contact with the rear side is not influenced by the process described above. Particularly, it is desirable that the upstream side in the first direction A1 is formed in a shape on which the sheet is unlikely to be caught. In addition, an area being in contact with the sheet may become smaller such that the reduction of the transport speed is prevented.

[2-5] Transport Path

The transport path in front or at the rear of the processing unit is provided substantially along a horizontal direction according to the present embodiment. However, there is no limitation, thereto, for example, the transport path may be provided along a vertical direction or may be provided in a direction intersecting with the directions described above. In addition, the transport path may form a curved line.

Figure 15:
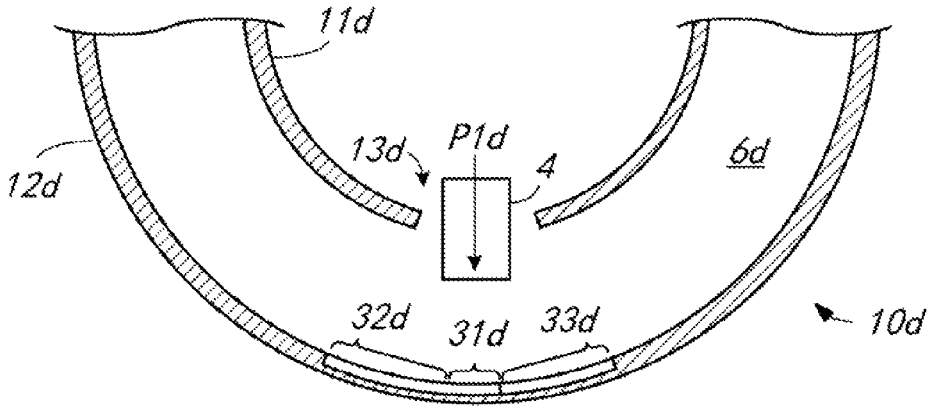
FIG. 15 is a view illustrating an example of a transport path of still another modification example.

FIG. 15 illustrates an example of a transport path of still another modification example. FIG. 15 illustrates a guide member 10$d$ that forms the transport path 6$d$ which forms an arc. The guide member 10$d$ has a first guide member 11$d$ on the inner side of the arc and has a second guide member 12$d$ on the outer side of the arc. The processing unit 4 is provided in the opening 13 which is formed by the first guide member 11$d$ and performs the process on the sheet that reaches the processing position P1*d*. The second guide member 12*d* has plural convex portions in a first region 31*d* including the processing position P1*d* and in second regions 32*d* and 33*d* not including the processing position P1*d*. A sheet which is transported through a transport path 6*d* is likely to come into contact with the outer side of the arc. However, since plural convex portions are provided in the region, the reduction of the speed at the processing position P1*d* is prevented.

[2-6] Number and Width of Convex Portions

According to the present embodiment, the first number which is the number of the convex portions in the first region 31 is greater than the second number which is the number of the convex portions in each of the second regions 32 and 33. However, there is no limitation thereto.

Figure 16:
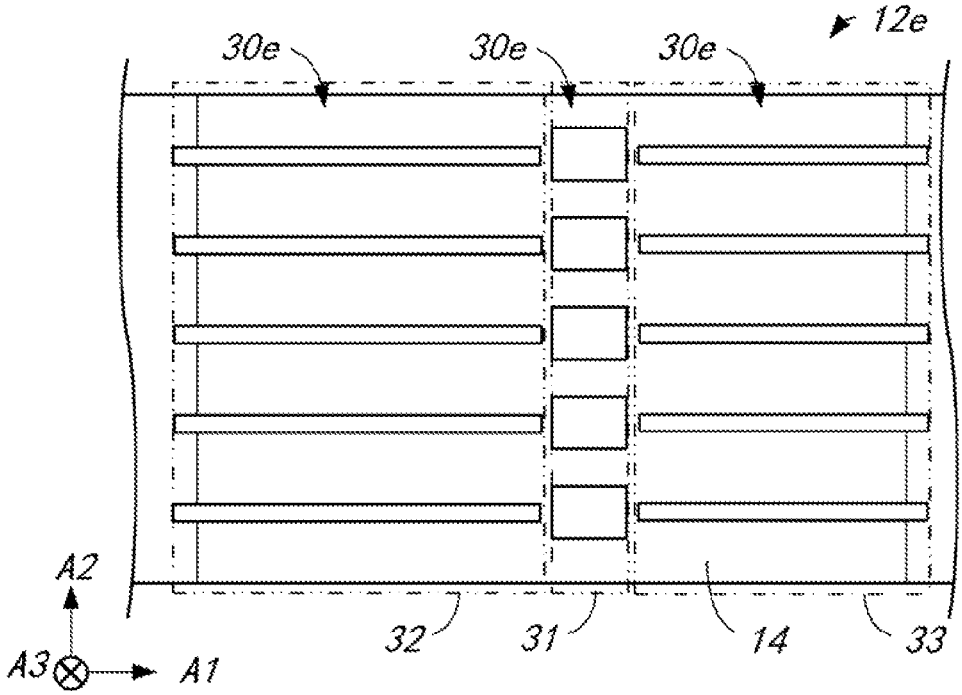
FIG. 16 is a view illustrating a second guide member of still another modification example.

FIG. 16 illustrates a second guide member 12*e* of the present modification example. The second guide member 12*e* has plural convex portions 30*e* and specifically has five convex portions 30*e* disposed to be arranged in the second direction A2 in each of the first region 31, the second region 32, and the second region 33.

The five convex portions 30*e* provided in the first region 31 are greater in size in the second direction A2 than the five convex portions 30*e* provided in the second regions 32 and 33. Therefore, an average of intervals between the plural convex portions 30*e* in the first region 31 is less than an average of intervals between the plural convex portions 30*e* in the second regions 32 and 33, and the deflection of the sheet at the processing position P1 is prevented as in the present embodiment. In addition, since friction is not produced between the sheet and the regions between the convex portions 30*e* even in the first region 31, the frictional force acting on the sheet is decreased, compared to a case where only the substrate 14 is provided in the second guide member 12*e*. The same is true in a case where the convex portions provided in the first region 31 become less.

[2-7] Method of Providing Convex Portions

According to the present embodiment, ribs are formed on the substrate 14 to provide the plural convex portions. However, there is no limitation thereto.

Figure 17:
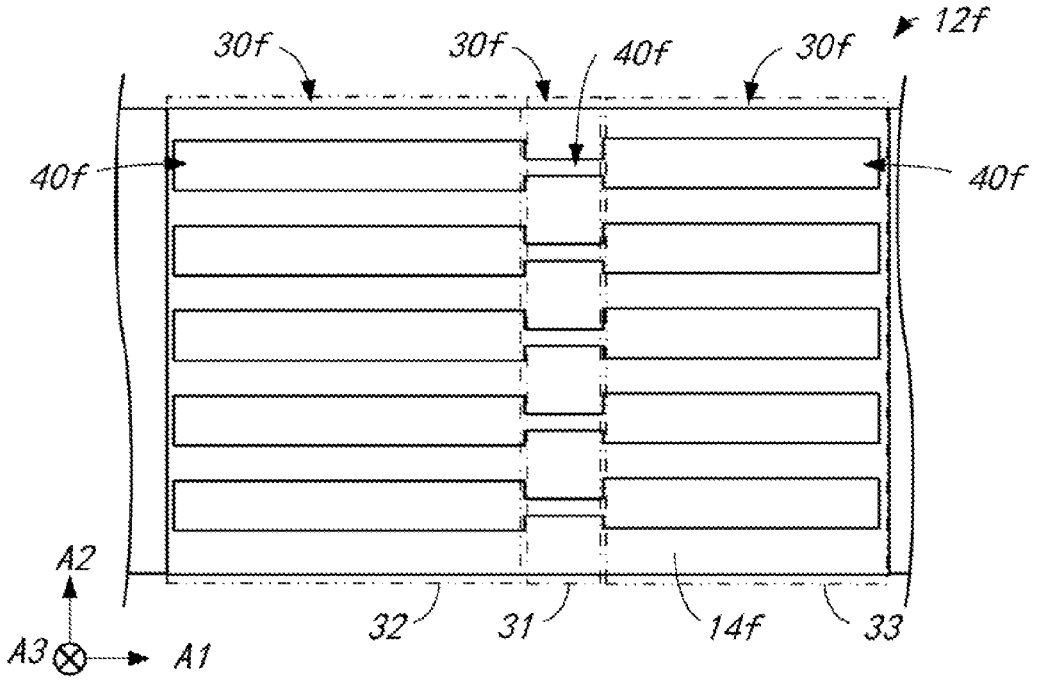
FIG. 17 is a view illustrating a second guide member of still another modification example.

FIG. 17 illustrates a second guide member 12*f* of the present modification example. The second guide member 12*f* has a substrate 14*f*, plural concave portions 40*f* formed to be hollowed out of the substrate 14*f*, and plural convex portions 30*f* formed to be sandwiched by the adjacent concave portions 40*f*. In the example in FIG. 17, an average of intervals between the plural convex portions 30*f* in the first region 31 is less than an average of intervals between the plural convex portions 30*f* in the second regions 32 and 33. In this manner, a portion which is raised relatively with respect to a hollowed portion which is hollowed out of the substrate may be provided as a convex portion in the second guide member.

Figure 18:
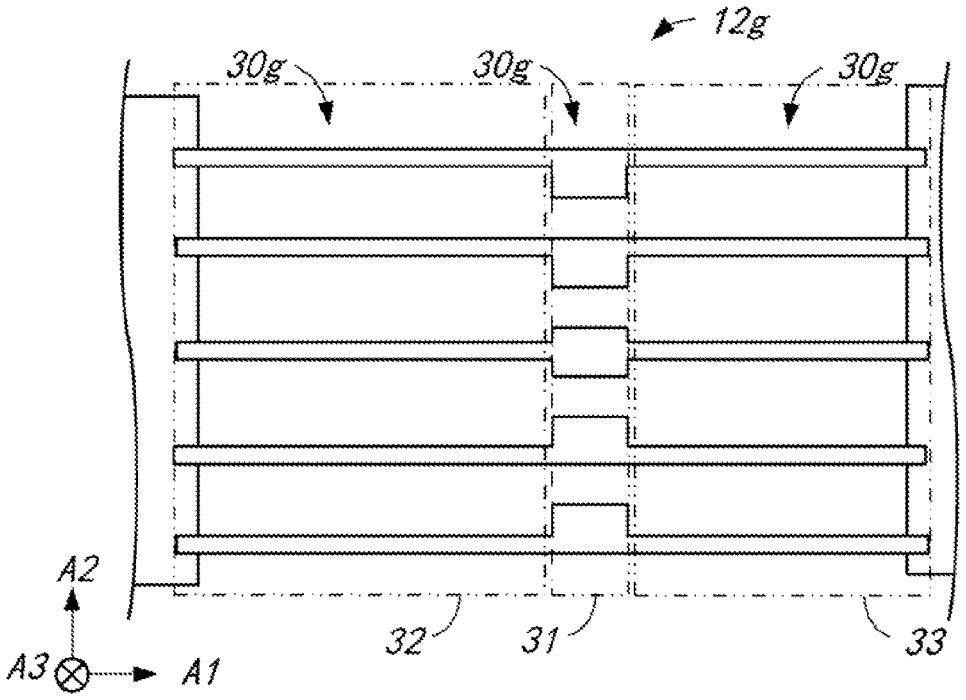
FIG. 18 is a view illustrating a second guide member of still another modification example.

FIG. 18 illustrates a second guide member 12*g* of the present modification example. The second guide member 12*g* has plural convex portions 30*g* in each of the first region 31, and the second regions 32 and 33, but does not have a substrate. These convex portions 30*g* are provided by forming a rod-shaped member that is continuous with both of a guide member on the upstream side of the second region 32 and a guide member on the downstream side of the second region 33. In the example in FIG. 18, an average of intervals between the plural convex portions 30*g* in the first region 31 is less than an average of intervals between the plural convex portions 30*g* in the second regions 32 and 33. In this case, since a sheet is guided by the plural convex portions 30*g*, the second guide member 12*g* functions as a member which forms the transport path and guides the sheet.

[2-8] Second Region

According to the present embodiment, the plural convex portions are provided in the second regions on both the upstream side and the downstream side front the first region 31 in the first direction A1. However, there is no limitation thereto, and plural convex portions may be provided only in one second region. For example, when the sheet often comes into contact with the second guide member on the upstream side of the processing position P1, plural convex portions may be provided in the second region on the upstream side of the first region. By this, the reduction of the transport speed of the sheet at the processing position P1 is prevented, compared to a case where the plural convex portions are not provided. In this manner, for example, the plural convex portions may be provided in the second region with which the sheet is likely to conic into contact, and plural convex portions may not be provided in the second region with which the sheet is unlikely to come into contact. In addition, according to the present embodiment, the second regions 32 and 33 are regions continuous with the first region 31, but may be regions separate from the first region 31. In short, the second region may be a region present on the upstream side or the downstream side font the first region 31 in the first direction A1, the region facing the second surface of the sheet which is transported, and with which the second surface is likely to come into contact with the second guide member.

[2-9] Second Direction

According to the present embodiment, a direction which forms an angle of 90 degrees to the first direction A1 is named the second direction A2. However, the angle formed by the first direction A1 and the second direction A2 may be an angle other than 90 degrees. In any case, the plural convex portions may be provided to be arranged in the second direction A2 in the first region including the processing position P1 and in the second regions not including the processing position P1.

[2-10] Dispositional Range of Convex Portions

According to the present embodiment, the plural convex portions 30 are provided in a range narrower than the size (that is, width of the sheet, hereinafter, referred to as "sheet width") of the sheet. 9 in the second direction as illustrated in FIG. 7, but may be provided in a range wider than the sheet width. In the example in FIG. 5, one convex portion 30 may be further provided on each outer side of the convex portions 311 and 319. In addition, the plural convex portions 30 may be provided in a range narrower than illustrated in FIG. 7 in the second direction. In the example in FIG. 5, only seven convex portions 30 of the convex portions 312 to 318 may be provided. Even in this case, when the processing portion D1 described in FIG. 14 is included in the region in which the plural convex portions 30 are provided, the deflection of the sheet in the processing portion D1 may be prevented. That is, when the deflection of the sheet in the processing portion D1 is prevented, there is no problem even in a case where an end of the sheet in the second direction A2 is deflected.

In addition, as illustrated in the example in FIG. 7, the convex portions 30 (convex portions 311 and 319 in the example in FIG. 7) at the end in the second direction A2 may be provided to be closer to the center in the second direction A2 than the end of the processing portion D1 in the second direction A2. In this case, it is desirable that the distance between the convex portions 30 at the end in the second direction A2 and the end of the processing portion D1 in the second direction A2 is less than a length in accordance with the intervals of the plural convex portions 30. The length corresponding to the intervals of the plural convex portions 30 means half or a third of the intervals of the plural convex portions 30. A size of the deflection in the processing portion D1 on the outer side from the convex portions 30 at the end may be determined so as not to exceed the size of the deflection in the processing portion D1 sandwiched between the convex portions 30.

[2-11] Average of Intervals

According to the present embodiment, the arithmetic average is used as the average of the intervals of the convex portions but, instead of that, a weighted average may be used. For example, since it is desirable that, when being closer to the end in the second direction A2 as described above, the intervals become narrower, the weighted average which places greater weighting on the intervals is used when being closer to the end in the second direction A2. Accordingly, as in the modification example described above, the deviation of the deflection over the entire sheet along the second direction A2 becomes less.

In addition, the average of the intervals of the convex portions is represented by the number or density of the convex portions when the widths of the convex portions in the second direction A2 are equal to each other. For example, if the number of the convex portions in the first region 31 (the "first number" described above) is greater than the number of (the "second number" described above) the convex portions in the second regions 32 and 33, both the average of the intervals in the first regions 31 becomes smaller than the average of the intervals in the second regions 32 and 33. In the density of the convex portions, the higher the density is, the less the average of the intervals is. In this manner, if it is possible to compare the averages of the intervals of the convex portions, any index may be used.

[2-12] Category of the Invention

The present invention is thought to be included in a category of a guide member that forms a transport path. In addition, the invention is thought to be included in a category of a transport device that includes a roller unit and a processing unit, in addition to the guide member. Further, in a case where the processing unit performs reading of an image, the present invention is thought to be included in a category of an inspection device or an image reading device which output results dreading, in a case where the processing unit performs a process of ejecting ink, the present invention is thought to be included in a category of an image reading device. The present invention may be applied to any device which performs a process on a sheet which is transported.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled, in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and there equivalents.

What is claimed is:

1. A guide member comprising:

a first guide member that is disposed to face a first surface of a sheet which is transported to a first direction and that guides the sheet in front and at a rear of a processing position at which a process is performed on the first surface; and a second guide member that is disposed to face a second surface of the sheet and guides the sheet, wherein the second guide member includes first plural convex portions and second plural convex portions, the first plural convex portions are arranged in a second direction which forms a first angle to the first direction, the second plural convex portions are arranged in the second direction which forms a second angle to the first direction, the second plural convex portions are present in a first region including the processing position and a second region not including the processing position, and an average of the lengths of intervals between adjacent first plural convex portions in the first region is smaller than an average of the lengths of intervals between adjacent second plural convex portions in the second region.

2. The guide member according to claim 1, wherein the first plural convex portions are arranged so that an interval at a side closer to an end in the second direction is smaller than an interval at a center in the second direction.

3. The guide member according to claim 1, wherein the first plural convex portions include a convex portion of which a longitudinal direction is sloped with respect to the first direction in the first region.

4. The guide member according to claim 1, wherein the second plural convex portions include a convex portion of which a longitudinal direction is sloped with respect to the first direction in the first region.

5. The guide member according to claim 1, wherein the first plural convex portions and the second plural convex portions has a surface, at an upstream side in the first direction, that faces the first guide member and slopes at the upstream side in the first direction.

6. The guide member according to claim 1, wherein the first guide member includes a first contact region with which the first surface of the sheet comes in contact at the upstream side in the first direction from the processing position and a third contact region with which the first surface of the sheet comes in contact at a downstream side in the first direction from the processing position, and the second guide member includes a second contact region with which the second surface of the sheet comes in contact at the upstream side in the first direction from the processing position and a fourth contact region with which the second surface of the sheet comes in contact at the downstream side in the first direction.

7. A guide member comprising:

a first guide member that is disposed to face a first surface of a sheet which is transported to a first direction and that guides the sheet in front and at a rear of a processing position at which a process is performed on the first surface; and a second guide member that is disposed to face a second surface of the sheet and guides the sheet, wherein the second guide member includes first plural convex portions and second plural convex portions, the first plural convex portions have a surface or a line which extends in a second direction which forms a first angle to the first direction, the second plural convex portions are arranged in the second direction which forms a second angle to the first direction, the second plural convex portions are present in a first region including the processing position and a second region not including the processing position, the first guide member including a first region with which the first surface of the sheet comes in contact at the stream side in the first direction from the processing position and a third contact region with which the first surface of the sheet comes in contact at a downstream side in the first direction from the processing position, the second guide member including a second contact region with which the second surface of the sheet comes in contact at the upstream side in the first direction from the first contact re ion and a fourth contact region with which the second surface of the sheet comes in contact at the downstream side in the first direction from the third contact region, the first contact region and the third contact region projecting to the first surface, and the second contact region and the fourth contact region projecting to the second surface.

8. The guide member according to claim 7, wherein the second plural convex portions each have a longitudinal direction being sloped with respect to the first direction in the second region.

9. The guide member according to claim 7, wherein the first convex portion and the second plural convex portions have, at an upstream side in the first direction, a surface that faces the first guide member and slopes to the upstream side in the first direction.

10. A transport device comprising:

the guide member according to claim 1; and a roller unit that has plural rollers and transports the sheet along a transport path in the first direction by rotating the plural rollers.

11. The transport device according to claim 10, wherein the first plural convex portions are arranged so that an interval at a side closer to an end in the second direction is smaller than an interval at a center in the second direction.

12. The transport device according to claim 10, wherein the first plural convex portions each have a longitudinal direction being sloped with respect to the first direction in the first region.

13. The transport device according to claim 10, wherein the first plural convex portions and the second plural convex portions have, at an upstream side in the first direction, a surface that faces the first guide member and slopes to the upstream side in the first direction.

14. The transport device according to claim 10, wherein the first guide member includes a first contact region with which the first surface of the sheet comes in contact at the upstream side in the first direction from the processing position and a third contact region with which the first surface of the sheet comes in contact at a downstream side in the first direction from the processing position, and the second guide member includes a second contact region with which the second surface of the sheet comes in contact at the upstream side in the first direction from the first contact region and a fourth contact region with which the second surface of the sheet comes in contact at the downstream side in the first direction from the third contact region.

15. A transport device comprising:

the guide member according to claim 7; and a roller unit that has plural rollers and transports the sheet along a transport path in the first direction by rotating the plural rollers.

16. The transport device according to claim 15, wherein the second plural convex portions each have a longitudinal direction being sloped with respect to the first direction in the second region.

17. The transport device according to claim 15, wherein the first convex portion and the second plural convex portions have, at an upstream side in the first direction, a surface that faces the first guide member and slopes to the upstream side in the first direction.

18. The transport device according to claim 15, wherein the first guide member includes a first contact region with which the first surface of the sheet comes in contact at the upstream side in the first direction from the processing position and a third contact region with which the first surface of the sheet comes in contact at a downstream side in the first direction from the processing position, and the second guide member includes a second contact region with which the second surface of the sheet comes in contact at the upstream side in the first direction from the first contact region and a fourth contact region with which the second surface of the sheet comes in contact at the downstream side in the first direction from the third contact region.

* * * * *